United States Patent [19]

Kallmann

[11] Patent Number: 5,011,092

[45] Date of Patent: Apr. 30, 1991

[54] METHOD OF RANDOM DOFFING WOUND PACKAGES FROM TWO SIDES OF A TEXTILE YARN PROCESSING MACHINE

[75] Inventor: Jürgen Kallmann, Kaarst, Fed. Rep. of Germany

[73] Assignee: Palitex Project Company GmbH, Krefeld, Fed. Rep. of Germany

[21] Appl. No.: 499,772

[22] Filed: Mar. 27, 1990

[30] Foreign Application Priority Data

Apr. 17, 1989 [DE] Fed. Rep. of Germany ..... 3912513

[51] Int. Cl.[5] ..... B65H 54/26; B65H 67/06

[52] U.S. Cl. ..... 242/35.5 A

[58] Field of Search ..... 242/35.5 A, 35.5 R; 198/348, 356

[56] References Cited

U.S. PATENT DOCUMENTS

| | | | |
|---|---|---|---|
| 3,160,359 | 12/1964 | Furst | 242/35.5 R |
| 3,356,306 | 12/1967 | Furst | 242/35.5 R |
| 4,541,577 | 9/1985 | Suzuki et al. | 242/35.5 A |
| 4,582,270 | 4/1986 | Asai et al. | 242/35.5 A |

FOREIGN PATENT DOCUMENTS

| | | |
|---|---|---|
| 2815105 | 10/1978 | Fed. Rep. of Germany . |
| 3244015 | 5/1984 | Fed. Rep. of Germany . |
| 3332409 | 3/1985 | Fed. Rep. of Germany . |
| 3511815 | 10/1986 | Fed. Rep. of Germany . |
| 3731125 | 5/1988 | Fed. Rep. of Germany . |
| 0274626 | 7/1988 | Fed. Rep. of Germany . |
| 3802900 | 8/1988 | Fed. Rep. of Germany . |

*Primary Examiner*—Stanley N. Gilreath

*Attorney, Agent, or Firm*—Bell, Seltzer, Park & Gibson

[57] ABSTRACT

A method of automatically removing takeup packages of a two-sided textile machine, in particular a winding, spinning, or twisting machine with random doff by at least one automated handling device traveling along the longitudinal sides of the machine and of depositing the removed takeup packages on a conveyor belt common to both machine sides, which is arranged in the longitudinal center of the machine and adapted for a stepwise forward movement, and which is followed by a buffer zone. The automated handling device checks at each position of a due package doff and before delivering a takeup package to the conveyor belt, whether the belt is vacant at this position or already occupied by a takeup package. In the event of an occupancy, the automated handling device supplies to the conveyor belt drive a control signal, by which the conveyor belt is stepwise advanced until a vacant space on the conveyor belt arrives at this position. As soon as the buffer zone is completely filled with takeup packages, an alarm signal is emitted to a superposed monitoring device, which triggers a clearance of the conveyor belt. The present method allows to achieve a utilization factor of more than 50% of the conveyor belt.

3 Claims, 3 Drawing Sheets

METHOD OF RANDOM DOFFING WOUND PACKAGES FROM TWO SIDES OF A TEXTILE YARN PROCESSING MACHINE

FIELD OF THE INVENTION

The invention relates to a method of automatically removing wound packages or takeup packages of a two-sided textile yarn processing machine, in particular a winding, spinning or twisting machine with random doff by means of an automatic handling device moving along the longitudinal sides of the machine, and of depositing the removed takeup packages on a conveyor belt common to both machine sides, which is arranged in the longitudinal center of the machine and adapted for a stepwise forward movement, and which is followed by a buffer zone.

BACKGROUND OF THE INVENTION

Modern textile machines are constructed as multiposition machines, it being possible to use conveyor belts for the removal of takeup packages, which belts are accommodated in the region of the central longitudinal axis of the machine inside the machine frame. The finished takeup packages are delivered to these conveyor belts either by hand or by automated handling devices. When the packages are doffed by the so-called random doffing method, in which a doff occurs, under circumstances at relatively widely spaced-apart positions, which need to be doffed, the problem will arise in the case of a two-sided textile machine that a position on the conveyor belt, on which a takeup package is to be deposited, is already occupied, because a takeup package was deposited thereon shortly before from the opposite machine side.

To solve this problem, it already known to arrange two conveyor belts along the center axis of a textile machine. Such apparatus are described, for example, in published German patent documents DE-OS 32 44 015 and DE-OS 33 32 409.

In these known apparatus, the package conveyor belts are arranged side by side in one plane and move in opposite directions. Located at the one end of the two conveyor belts is a device for transferring the packages from the one conveyor belt to the other. In such an apparatus, it is not possible that packages from the one or the other machine side collide. The disadvantage of such an apparatus is that it results in an excessively wide textile machine, which greatly affects the room conditions when the machines are installed.

Furthermore, published German patent document DE-OS 35 11 815 discloses an automatic winding machine with a traveling package doffer, which comprises a package conveyor belt. Arranged above the package conveyor belt is a device for gripping and lifting the packages, which serves as an expanded storage and to which the packages can be transferred from the conveyor belt and temporarily stored thereon. However, the packages are not further transported by the package gripping and lifting device, but need to be returned to the package conveyor belt for their continued transportation.

OBJECT AND SUMMARY OF THE INVENTION

It is the object of the present invention to provide a method of random doffing wound packages with an automated handling device from parallel successive takeup zones on two sides of a textile yarn processing machine onto a driven conveyor belt extending centrally of the machine between the successive parallel zones, and wherein the method is characterized by providing a vacant position on the conveyor belt for doffing a would package from a particular takeup zone regardless of previously doffed wound packages on the conveyor belt.

This object is accomplished in accordance with the present invention by providing such a method including the steps of successively sensing with the automated handling device whether the positions on the conveyor belt adjacent the takeup zone having a wound package to be doffed is vacant or occupied by a doffed wound package and signaling the drive of the conveyor belt, advancing the conveyor belt in stepwise movements, if a signal is received that the position is occupied, until the signal indicates that the position is vacant, providing a buffer zone device at the forward end of the conveyor belt and transferring wound packages from the forward end of the conveyor belt as such wound packages reach the forward end of the conveyor belt during stepwise advancing movements of the conveyor belt, and successively doffing and wound packages with the automated handling device from the takeup zones onto the vacant positions of the conveyor belt.

The basic concept of the invention is to see to a corresponding control of the conveyor belt, so that, no matter on which position a random doff is to occur, a vacant position will always be available or can be made available on the conveyor belt. The method of the present invention permits a takeup package deposited on the conveyor belt to remain in the same place thereon as long as the belt is not needed for a subsequent doff. For example, this is the case, when, once a package from the one machine side is placed on the conveyor belt, a package is doffed on the opposite machine side. In this event, the conveyor belt is advanced controlled by the automated handling device until an unoccupied position arrives at the respective position.

It has shown that the method of the present invention allows to achieve an extraordinarily good utilization factor of the conveyor belt, before it is necessary to evacuate the entire belt. This applies in particular when a buffer zone is included in the method such that as the conveyor belt is advanced, the takeup packages arriving at the end of the belt are taken over by the buffer zone, which gradually fills, so that an evacuation becomes necessary only when the entire buffer zone is filled. It has further shown that the accomplishable utilization factor of the positions on the conveyor belt increases for a predetermined number of loading positions on the belt, which are dependent on the number of positions of the machine, with the number of places available in the buffer zone. On the other hand, it is natural that a best possible utilization factor is achieved with the fewest possible buffer spaces. A very good utilization of the conveyor belt can be accomplished, when the number P of the spaces on the buffer zone with the total number N of the positions on the conveyor belt corresponds at least approximately to the equation $P=\sqrt{N}$.

An automated handling device checks the positions on the conveyor belt for "occupancy" or "vacancy", suitably with contactlessly operating sensors, which may be in the form of reflective light barriers.

It has also been found that a random doff results after a relatively short period of time in such a good, statistic distribution of due package doffs over the entire length of the machine, that an extremely good utilization factor of the conveyor belt is already reached before it is necessary to occupy the buffer zone.

The method of the present invention allows to achieve, without any great expenditure, a utilization of the conveyor belt of more than 50%.

Brief Description of the Invention

Embodiments of the method according to the present invention will be described hereinbelow in more detail with reference to the attached drawings, in which.

DESCRIPTION OF PREFERRED EMBODIMENT OF THE INVENTION

Figure 1:
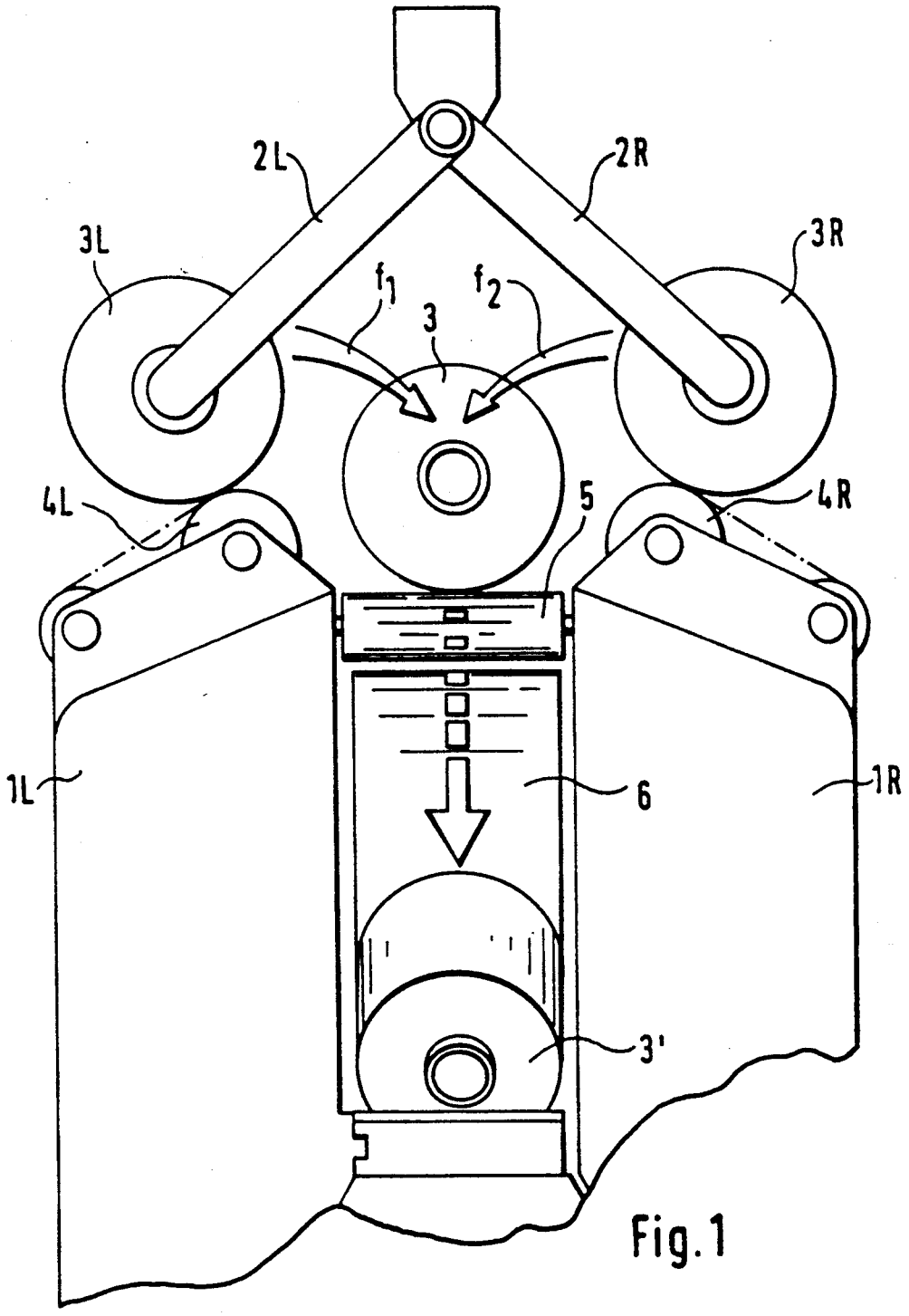
FIG. 1 is a schematic front end side view of the takeup portion of a spinning or twisting machine.

Shown in FIG. 1 is the front end side view of the takeup portion of a spinning or twisting machine. A typical two-sided construction of the machine can be noted, the left side of the machine being indicated in FIG. 1 at 1L and the right machine side at 1 R. Yarns not specially shown advance from the spinning or winding positions of the machines and are wound in the takeup zone on packages 3L and 3R respectively, which are each supported in a cradle 2L and 2R and driven by a friction drive 4L and 4R. A conveyor belt 5 extends in the longitudinal center of the machine. During a doff, the packages 3L and 3R are picked up by an automated handling device not shown in FIG. 1, removed from the cradles 2L and 2R respectively, and, as is indicated by arrows f1 and f2, deposited on the conveyor belt 5, on which one package 3 is shown. The conveyor belt 5 is followed by a buffer zone 6, which is shown as a drop-off in FIG. 1 and shows a package 3' deposited therein.

The sequence of the method of automatically removing the takeup packages will be explained in more detail hereinbelow with reference to FIG. 2.

The illustrated machine possesses 9 winding or twisting positions on each of the two sides of the machine. The corresponding takeup packages are indicated on the left side at 3.1L to 3.9L and on the right side at 3.1R to 3.9R. The packages are shown in differently wound conditions.

The conveyor belt 5 can be moved stepwise by a drive 8 in direction of the arrow and has a total of nine loading positions, indicated at 5.1 to 5.9, between each of the opposing twisting or spinning positions.

The buffer zone 6, which is likewise constructed as a conveyor belt, is provided with its own drive 9 and a sensory limit stop 10, which is coupled with a signal transmitter 11, the latter emitting a signal for removal to a monitoring device 12 not shown, when all spaces in the buffer zone 6 are occupied. Naturally, a buffer zone may also be designed and constructed as a chute or roller track.

Two automated handling devices 7L and 7R, which doff the packages, are adapted to travel along the two longitudinal sides of the machine. Naturally, also a single automated handling device may be present, which services both machine sides.

Each automated handling device 7L or 7R is provided with a device 7.1L or 7.1R, which permits it to check whether a vacant space is present at a corresponding position 5.1 to 5.9 for a package doff or whether it is already occupied by a takeup package. Suitably, these devices are constructed as contactless sensors of a type known per se, such as, for example, photocells, which respond to a sensing light beam or a light barrier emitted by the automated handling device.

Figure 2:
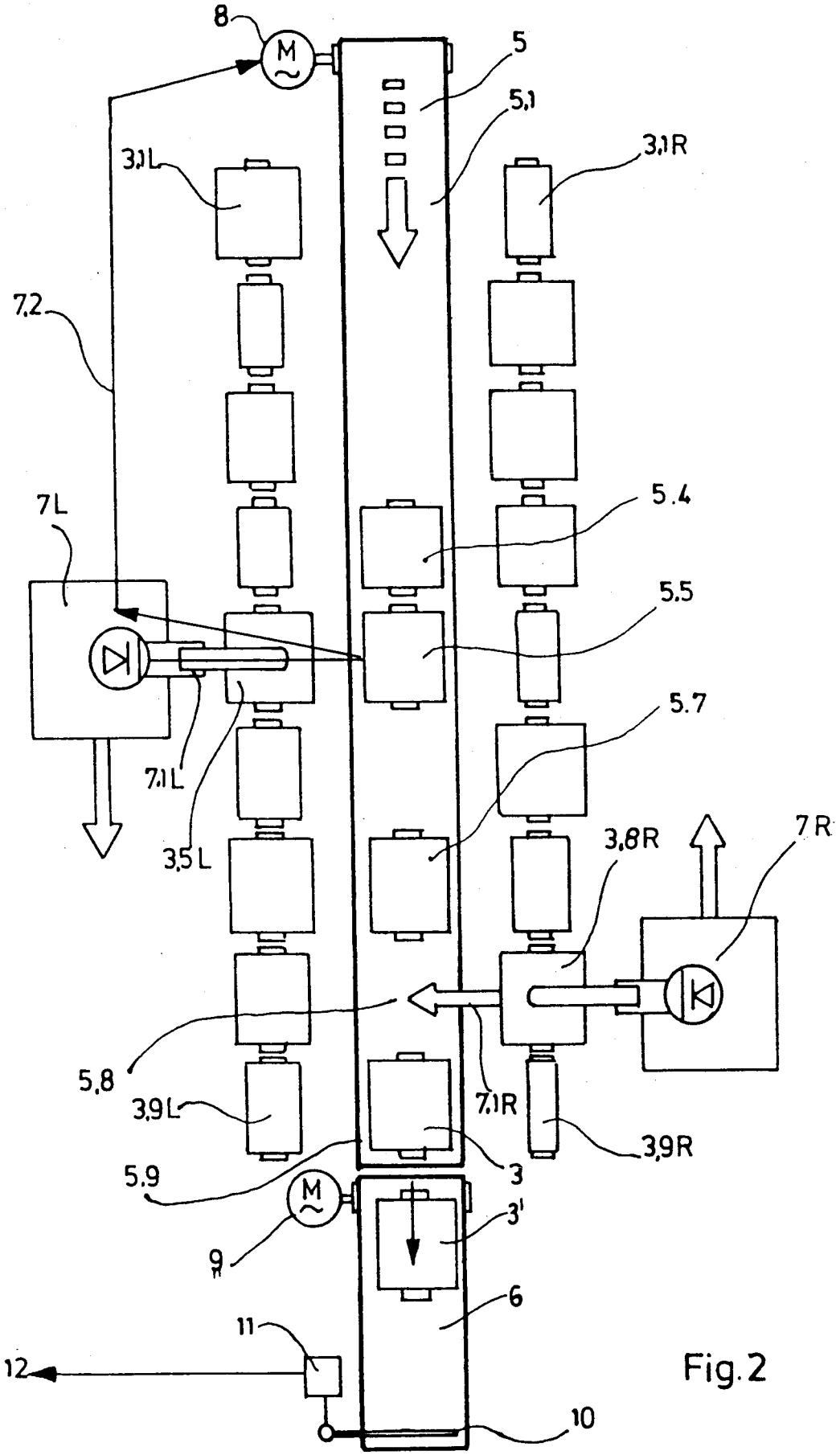
FIG. 2 is a schematic top view of the machine of FIG. 1.

In the operating condition shown in FIG. 2, four takeup packages are already deposited on the conveyor belt 5 at the positions 5.4, 5.5, 5.7 and 5.9. Another takeup package 3' is already in the buffer zone 6.

When now, for example, the package 3.8R on the right side is fully wound and ready to be doffed by the automated handling device 7R, same first checks by means of the device 7.1R for the vacancy of position 5.8 on the conveyor belt 5. In the illustrated embodiment, such a vacancy is present, and the package 3.8R can be loaded on the conveyor belt 5.

Meanwhile on the left side of the machine, the takeup package 3.5L has been fully wound and is ready to be doffed by the automated handling device 7L. A check by the device 7.1L for a corresponding position 5.5 on the conveyor belt 5 results that same is already occupied by a takeup package from the opposite side. The space is no longer available. Likewise taken is the position 5.4 by a package which was deposited thereon from the left side. As a result, the automated handling device emits, via a line 7.2, which may, for example, be its own track, control signals to the drive 8, which lead to a stepwise forward movement of the conveyor belt 5. These control signals are emitted until the forward movement of the conveyor belt 5 leads to a vacant space at the position 5.5.

However, as can be noted from FIG. 2, the conveyor belt 5 accommodates already 5 takeup packages, i.e., more than 50% of its positions are occupied. When the automated handling device 7L emits now its control signal to the drive, the package 3 is then transferred by one stepping motion to the buffer zone 6 and the package 3' is moved forward in the buffer zone 6, which is thus fully occupied. As a result thereof, a signal is emitted via the signal transmitter 11 to the monitoring device 12, which triggers a clearance of the entire conveyor belt 5.

For reasons of simplicity, FIG. 2 illustrates an embodiment with only very few spinning or twisting positions and only few buffer spaces. In general, however, standard spinning or twisting machines possess many more spinning or twisting positions, and consequently the number of spaces in the buffer zone is correspondingly larger.

For a better illustration of the utilization factor in this method, a stepwise performance of the latter will be described with reference to FIG. 3 in the form of a table and with reference to the example of a machine having a conveyor belt with 64 loading positions and a buffer zone with 8 spaces.

Figure 3:
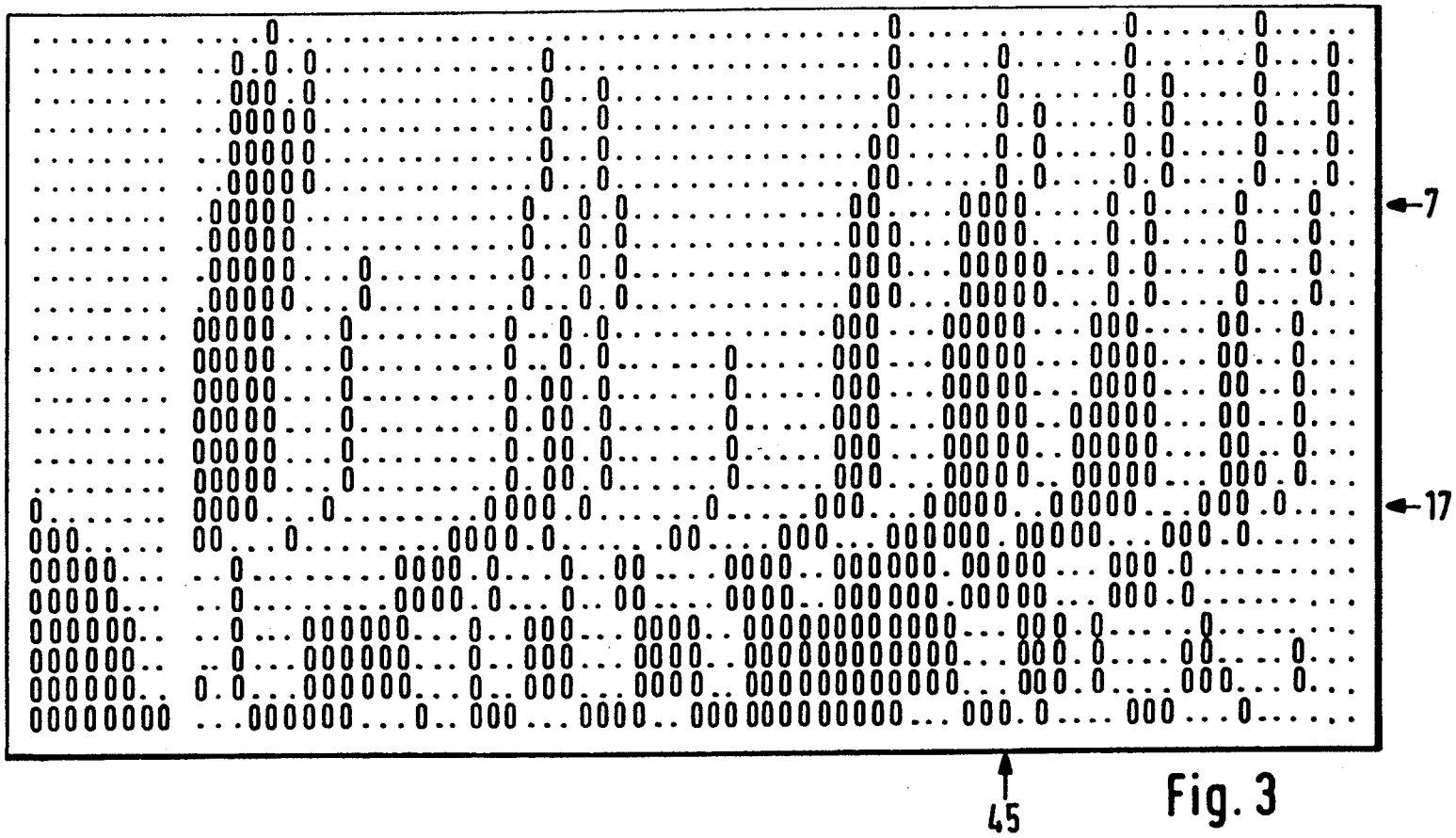
FIG. 3 is a tabular overview of the loading operation of a conveyor belt with 64 positions and a buffer zone with 8 spaces.

The illustration of FIG. 3 is in the form of a matrix, in which each line of the matrix indicates successive steps of the method, whereas the first eight columns represent the spaces in the buffer zone, and the following 64 columns the positions on the conveyor belt. The spaces occupied by takeup packages are each indicated by "0".

As can be noted from line 1, the method starts with the depositing of four takeup packages on the conveyor belt. In lines 2 to 6, more packages are added, without having to advance the conveyor belt. Only in line 7, is the conveyor belt advanced by one position, since a package is to be deposited in column 45, i.e., on position 45, and this position is already taken by a package, as can be noted from line 6. Another advance motion by one step occurs in line 11. With this step, a package reaches the end of the conveyor belt, and by another stepwise forward movement, this package is transferred in line 17 to the buffer zone. Additional packages are loaded and additional stepwise advance movements occur until the buffer zone is fully occupied in line 24. 34 takeup packages still remain on the conveyor belt, which corresponds to a utilization factor of available spaces of 53%. If the 8 packages in the buffer zone are added, a utilization of about 66% will be accomplishable when proceeding with an evacuation.

As already described, the buffer zone now emits a signal, which triggers the clearance of the entire conveyor belt including the buffer zone.

I claim:

1. Method of random doffing wound packages with an automated handling device from parallel successive takeup zones on two sides of a textile yarn processing machine onto a driven conveyor belt extending centrally of the machine between the successive parallel takeup zones, said method being characterized by providing a vacant position on the conveyor belt for doffing a wound package from a desired takeup zone regardless of previously doffed wound packages on the conveyor belt; said method comprising the steps of:

successively sensing with the automated handling device whether the position on the conveyor belt adjacent the takeup zone having a wound package to be doffed is vacant or occupied by a doffed wound package, and signaling the drive of the conveyor belt;

advancing the conveyor belt in stepwise movements is a signal is received that the position is occupied and until the signal indicates that the position is vacant;

providing a buffer zone device at the forward end of the conveyor belt and transferring wound packages from the forward end of the conveyor belt as such wound packages reach the forward end of the conveyor belt during stepwise advancing movements of the conveyor belt; and successively doffing the wound packages with the automated handling device from the desired takeup zones onto the vacant positions on the conveyor belt.

2. Method, as set forth in claim 1, further including the step of sensing when the buffer zone device is fully loaded with wound packages and effecting a complete unloading of wound packages from the conveyor belt and the buffer zone device.

3. Method, as set forth in claim 1 or 2, wherein the step of providing a buffer zone device includes providing a buffer zone device having positions therein for receiving wound packages which correspond at least approximately to the square root of the total number of positions which may e occupied by wound packages on the conveyor belt.

* * * * *

UNITED STATES PATENT AND TRADEMARK OFFICE

CERTIFICATE OF CORRECTION

PATENT NO. : 5,011,092

DATED : April 30, 1991

INVENTOR(S) : Jurgen Kallmann

It is certified that error appears in the above-identified patent and that said Letters Patent is hereby corrected as shown below:

Column 2, line 5, "would" should be -- wound --.

Column 2, line 23, "and" should be -- the --.

Column 6, line 5, "is" should be -- if --.(1st Occur.)

Column 6, line 28, "e" should be -- be --.

Signed and Sealed this

Tenth Day of November, 1992

*Attest:*

DOUGLAS B. COMER

*Attesting Officer*

*Acting Commissioner of Patents and Trademarks*